US012203726B2

(12) United States Patent
Dubois

(10) Patent No.: US 12,203,726 B2
(45) Date of Patent: Jan. 21, 2025

(54) BUTTSTOCK AND SPARE MAGAZINE LATCH

(71) Applicant: Smith & Wesson Inc., Springfield, MA (US)

(72) Inventor: Jason Dubois, North Smithfield, RI (US)

(73) Assignee: SMITH & WESSON INC., Springfield, MA (US)

( * ) Notice: Subject to any disclaimer, the term of this patent is extended or adjusted under 35 U.S.C. 154(b) by 0 days.

(21) Appl. No.: 18/505,250

(22) Filed: Nov. 9, 2023

(65) Prior Publication Data

US 2024/0151494 A1 May 9, 2024

Related U.S. Application Data

(60) Provisional application No. 63/423,896, filed on Nov. 9, 2022.

(51) Int. Cl.
*F41C 23/22* (2006.01)
*F41C 23/14* (2006.01)

(52) U.S. Cl.
CPC ..... *F41C 23/22* (2013.01); *F41C 23/14* (2013.01)

(58) Field of Classification Search
CPC ..... F41C 23/12; F41C 23/10
See application file for complete search history.

(56) References Cited

U.S. PATENT DOCUMENTS 1,526,847 A 2/1925 Fritz
4,115,943 A 9/1978 Musgrave
6,829,855 B2 12/2004 Seifert
D620,067 S 7/2010 Saur
7,823,313 B2 11/2010 Faifer
7,937,873 B2 5/2011 Keng
8,127,483 B2 3/2012 Kincel
8,127,658 B1 3/2012 Cottle
8,176,835 B1 5/2012 Cottle
D661,366 S 6/2012 Zusman
D668,311 S 10/2012 Rogers et al.
8,327,569 B2 12/2012 Kincel
8,341,868 B2 1/2013 Zusman
8,356,542 B2 1/2013 Cottle et al.
8,371,208 B2 2/2013 Cottle
(Continued)

FOREIGN PATENT DOCUMENTS

DE 3408637 A1 9/1985
KR 20170119605 A 10/2017

*Primary Examiner* — J. Woodrow Eldred
(74) *Attorney, Agent, or Firm* — Ballard Spahr LLP

(57) ABSTRACT

A latch for securing a buttstock to a receiver of a firearm. The buttstock has at least one compartment configured to receive a spare magazine. The latch comprises a shaft, a lever, a first spring, and a second spring. The shaft moves along a first axis within the buttstock and is biased by the first spring to engage with a recess in a receiver of the firearm. The lever extends along a second axis transverse to the first axis and is positioned between the buttstock and an end of the shaft. The second spring biases the lever toward the buttstock. The lever includes a projection configured to extend through an opening in the buttstock and engage with the spare magazine. The lever is pivotable and is configured to release the magazine when the lever is pivoted in a first direction.

20 Claims, 8 Drawing Sheets

(56) References Cited

U.S. PATENT DOCUMENTS

| | | | | |
|---|---|---|---|---|
| 8,448,562 | B2 | 5/2013 | Cottle | |
| 8,459,171 | B2 | 6/2013 | Cottle | |
| 8,474,169 | B2 | 7/2013 | Cottle et al. | |
| 8,607,687 | B2 | 12/2013 | Cottle | |
| 8,782,941 | B2 | 7/2014 | Zusman | |
| 8,806,791 | B2 | 8/2014 | Cottle | |
| 8,950,099 | B2 | 2/2015 | Rogers et al. | |
| 8,978,284 | B1 | 3/2015 | Zusman | |
| 8,978,285 | B1 | 3/2015 | Burke et al. | |
| 9,109,855 | B1 | 8/2015 | Kincel | |
| D738,981 | S | 9/2015 | Zusman | |
| D747,427 | S | 1/2016 | Zusman | |
| D748,216 | S | 1/2016 | Zusman | |
| 9,261,324 | B1 | 2/2016 | Liang et al. | |
| 9,400,156 | B2 | 7/2016 | Lamb | |
| 9,404,708 | B1 | 8/2016 | Chow et al. | |
| 9,546,836 | B2 | 1/2017 | Cottle et al. | |
| 9,551,549 | B1 | 1/2017 | Chvala | |
| 9,581,411 | B2 | 2/2017 | Zusman | |
| 9,612,083 | B2 | 4/2017 | Cottle et al. | |
| 9,746,281 | B2 | 8/2017 | Wilson et al. | |
| 9,784,526 | B2 | 10/2017 | Chow et al. | |
| 9,791,238 | B2 | 10/2017 | Bowen | |
| 9,909,835 | B1 | 3/2018 | Smith | |
| 10,240,891 | B2 | 3/2019 | Miller et al. | |
| 10,551,144 | B2 | 2/2020 | Overstreet et al. | |
| 10,760,875 | B2 | 9/2020 | Zhang | |
| 10,830,558 | B2 | 11/2020 | Underwood et al. | |
| 10,935,342 | B2 | 3/2021 | Miller et al. | |
| 11,112,209 | B2 | 9/2021 | Overstreet et al. | |
| 11,150,048 | B1 * | 10/2021 | Stephens | F41C 23/22 |
| 11,262,158 | B2 | 3/2022 | Cahill et al. | |
| 11,280,580 | B2 | 3/2022 | Liptak et al. | |
| 2006/0254111 | A1 | 11/2006 | Giauque et al. | |
| 2010/0229444 | A1 | 9/2010 | Faifer | |
| 2011/0099872 | A1 | 5/2011 | Bentley et al. | |
| 2013/0097911 | A1 | 4/2013 | Larue | |
| 2016/0097613 | A1 * | 4/2016 | Lamb | F41C 23/22<br>42/71.01 |
| 2017/0167825 | A1 | 6/2017 | Zusman | |
| 2019/0049213 | A1 | 2/2019 | Yang | |
| 2023/0107470 | A1 * | 4/2023 | Kolmakov | F41A 9/59<br>42/18 |
| 2023/0235990 | A1 * | 7/2023 | Keller | F41C 23/22<br>42/71.01 |

* cited by examiner

BUTTSTOCK AND SPARE MAGAZINE LATCH

CROSS-REFERENCE TO RELATED APPLICATION

This application claims the benefit of the filing date of U.S. Provisional Patent Application No. 63/423,896, filed Nov. 9, 2022, the entirety of which is hereby incorporated by reference herein.

FIELD

This disclosure relates to a latch for a buttstock and spare magazine for firearms, in particular, a latch for a removable or adjustable buttstock containing storage for spare magazines.

BACKGROUND

An adjustable buttstock can be an important aspect to proper gun fit as it may allow the length of pull to be customized to each shooter. The length of pull is the distance from the trigger to the back of the buttstock. A length of pull that is either too short or too long causes a poor and uncomfortable stance and negatively impacts the shooter's control of the firearm. Further, the buttstock may need to be completely removed from the receiver of the firearm to clean, repair, or disassemble/assemble other components of the firearm. A mechanism to allow the buttstock to be adjustable or to be removed and reattached is clearly beneficial.

Additionally, a buttstock which stores spare magazines is advantageous as it provides quick and easy access to extra magazines when a magazine is exhausted. A mechanism which enables a shooter to secure spare magazines in storage compartments in a buttstock and quickly release a spare magazine when it is needed is clearly beneficial.

There is an opportunity to improve devices which allow a buttstock to be adjusted or removable and allow a spare magazine to be secured and released from a storage compartment.

SUMMARY

An example latch for securing a buttstock to a receiver and securing a magazine in a compartment of the buttstock is disclosed.

An example latch for securing a buttstock to a receiver of a firearm according to the invention is comprised of a shaft, a lever, a first spring, and a second spring. The buttstock has at least one compartment configured to receive a spare magazine. The shaft is configured to extend through the buttstock and is movable along a first axis. The shaft includes a first end and a second end. The first end is configured to engage a recess in the receiver. The lever extends along a second axis transverse to the first axis and is positioned between a first surface of the buttstock and the second end of the shaft with the shaft extending through the lever. The lever includes a projection configured to extend through an opening in the first surface of the buttstock and engage with the spare magazine to secure the spare magazine within the at least one compartment. The lever is pivotable about a third axis that is perpendicular to the first and second axes. The projection is configured to release the magazine when the lever is pivoted in a first direction. The first spring is disposed within the buttstock with the shaft extending therethrough. The first spring biases the shaft toward the receiver. The second spring acts between the second end of the shaft and the lever with the shaft extending therethrough. The second spring biases the lever toward the first surface of the buttstock.

In an example embodiment, the lever includes a second projection configured to extend through a second opening in the first surface of the buttstock and engage with a second magazine received within a second compartment of the buttstock.

In an example embodiment, the second projection is configured to release the second magazine when the lever is pivoted in a second direction that is opposite the first direction.

In an example embodiment, a first spring constant of the first spring is greater than a second spring constant of the second spring.

In an example embodiment, the second end of the shaft includes a knob having a diameter that is larger than a diameter of the second spring.

In an example embodiment, a first portion of the shaft has a larger diameter than a second portion of the shaft.

In an example embodiment, the first portion comprises the first end of the shaft.

In an example embodiment, a transition between the first portion and the second portion forms an engagement surface.

In an example embodiment, the first spring acts between an interior surface of the buttstock and the engagement surface.

The disclosure also encompasses a removable or adjustable buttstock for a firearm. In an example embodiment, the buttstock comprises at least one compartment configured to store a magazine and a latch configured to secure the buttstock to a receiver of the firearm. The latch comprises a shaft, a lever, a first spring, and a second spring. The shaft extends through the buttstock and is movable along a first axis. The shaft includes a first end and a second end. The first end is configured to engage a recess in the receiver. The lever extends along a second axis transverse to the first axis and positioned between a first surface of the buttstock and the second end of the shaft with the shaft extending through the lever. The lever includes a projection configured to extend through an opening in the first surface of the buttstock and engage with the magazine to secure the magazine within the at least one compartment. The lever is pivotable about a third axis that is perpendicular to the first and second axes. The projection is configured to release the magazine when the lever is pivoted in a first direction. The first spring is disposed within the buttstock with the shaft extending therethrough. The first spring biases the shaft toward the receiver. The second spring acts between the second end of the shaft and the lever with the shaft extending therethrough. The second spring biases the lever toward the first surface of the buttstock.

In an example embodiment, the lever includes a second projection configured to extend through a second opening in the first surface of the buttstock and engage with a second magazine received within a second compartment of the buttstock.

In an example embodiment, the second projection is configured to release the second magazine when the lever is pivoted in a second direction that is opposite the first direction.

In an example embodiment, a first spring constant of the first spring is greater than a second spring constant of the second spring.

In an example embodiment, the second end of the shaft includes a knob having a diameter that is larger than a diameter of the second spring.

In an example embodiment, a first portion of the shaft has a larger diameter than a second portion of the shaft.

In an example embodiment, the first portion comprises the first end of the shaft.

In an example embodiment, a transition between the first portion and the second portion forms an engagement surface.

In an example embodiment, the first spring acts between an interior surface of the buttstock and the engagement surface.

In an example embodiment, the recess in the receiver is one of a plurality of recesses along the receiver.

The disclosure also encompasses a firearm. The firearm comprises a barrel, a receiver connected to the barrel, and a buttstock connected to the receiver. The buttstock comprises at least one compartment configured to store a magazine and a latch configured to secure the buttstock to a receiver of the firearm. The latch comprises a shaft, a lever, a first spring, and a second spring. The shaft extends through the buttstock and is movable along a first axis. The shaft includes a first end and a second end. The first end is configured to engage a recess in the receiver. The lever extends along a second axis transverse to the first axis and positioned between a first surface of the buttstock and the second end of the shaft with the shaft extending through the lever. The lever includes a projection configured to extend through an opening in the first surface of the buttstock and engage with the magazine to secure the magazine within the at least one compartment. The lever is pivotable about a third axis that is perpendicular to the first and second axes. The projection is configured to release the magazine when the lever is pivoted in a first direction. The first spring is disposed within the buttstock with the shaft extending therethrough. The first spring biases the shaft toward the receiver. The second spring acts between the second end of the shaft and the lever with the shaft extending therethrough. The second spring biases the lever toward the first surface of the buttstock.

In an example embodiment, the lever includes a second projection configured to extend through a second opening in the first surface of the buttstock and engage with a second magazine received within a second compartment of the buttstock.

In an example embodiment, the second projection is configured to release the second magazine when the lever is pivoted in a second direction that is opposite the first direction.

In an example embodiment, a first spring constant of the first spring is greater than a second spring constant of the second spring.

In an example embodiment, the second end of the shaft includes a knob having a diameter that is larger than a diameter of the second spring.

In an example embodiment, a first portion of the shaft has a larger diameter than a second portion of the shaft.

In an example embodiment, the first portion comprises the first end of the shaft.

In an example embodiment, a transition between the first portion and the second portion forms an engagement surface.

In an example embodiment, the first spring acts between an interior surface of the buttstock and the engagement surface.

In an example embodiment, the recess in the receiver is one of a plurality of recesses along the receiver.

DETAILED DESCRIPTION

Figure 1:
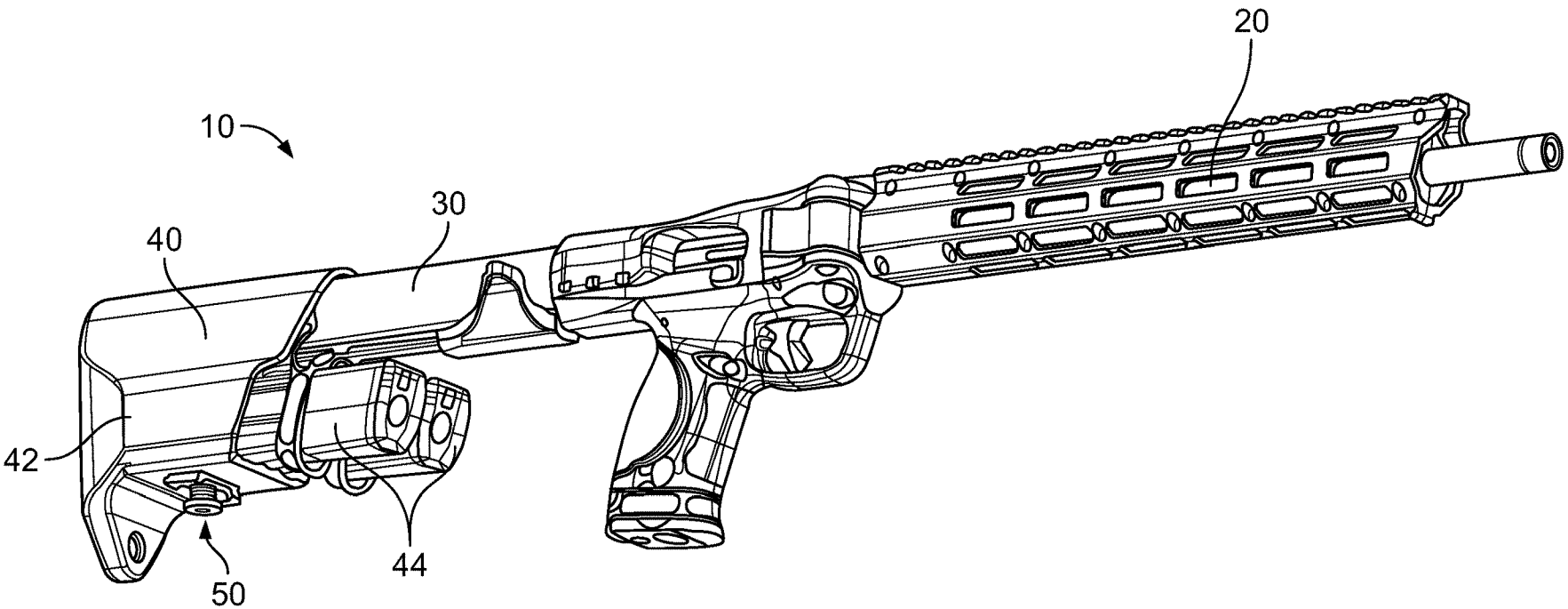
FIG. 1 is a perspective view of an example firearm according to the invention.

FIG. 1 shows a firearm 10, in this example a carbine. Although depicted in the drawings as a carbine, it is contemplated that other firearm designs and configurations can be compatible with the current disclosure. The firearm 10 comprises a barrel 20 connected to a receiver 30. The firearm 10 also comprises a buttstock 40 connected to the receiver 30. The buttstock 40 may be removably attached to the receiver 30. In one example, the buttstock 40 may be adjustable along a length of the receiver to adjust the length of pull. The buttstock 40 may also include at least one compartment 42 configured to store a spare magazine 44. In this example, the buttstock 40 includes two compartments 42 to store two spare magazines 44. However, it is contemplated that the buttstock 40 can include any practical number of compartments 42, such as, for example, a single compartment or three or more compartments. The buttstock 40 includes a latch 50 for securing the removable and/or adjustable buttstock 40 to the receiver 30 and to secure the spare magazines 44 within the compartments 42.

Figure 2:
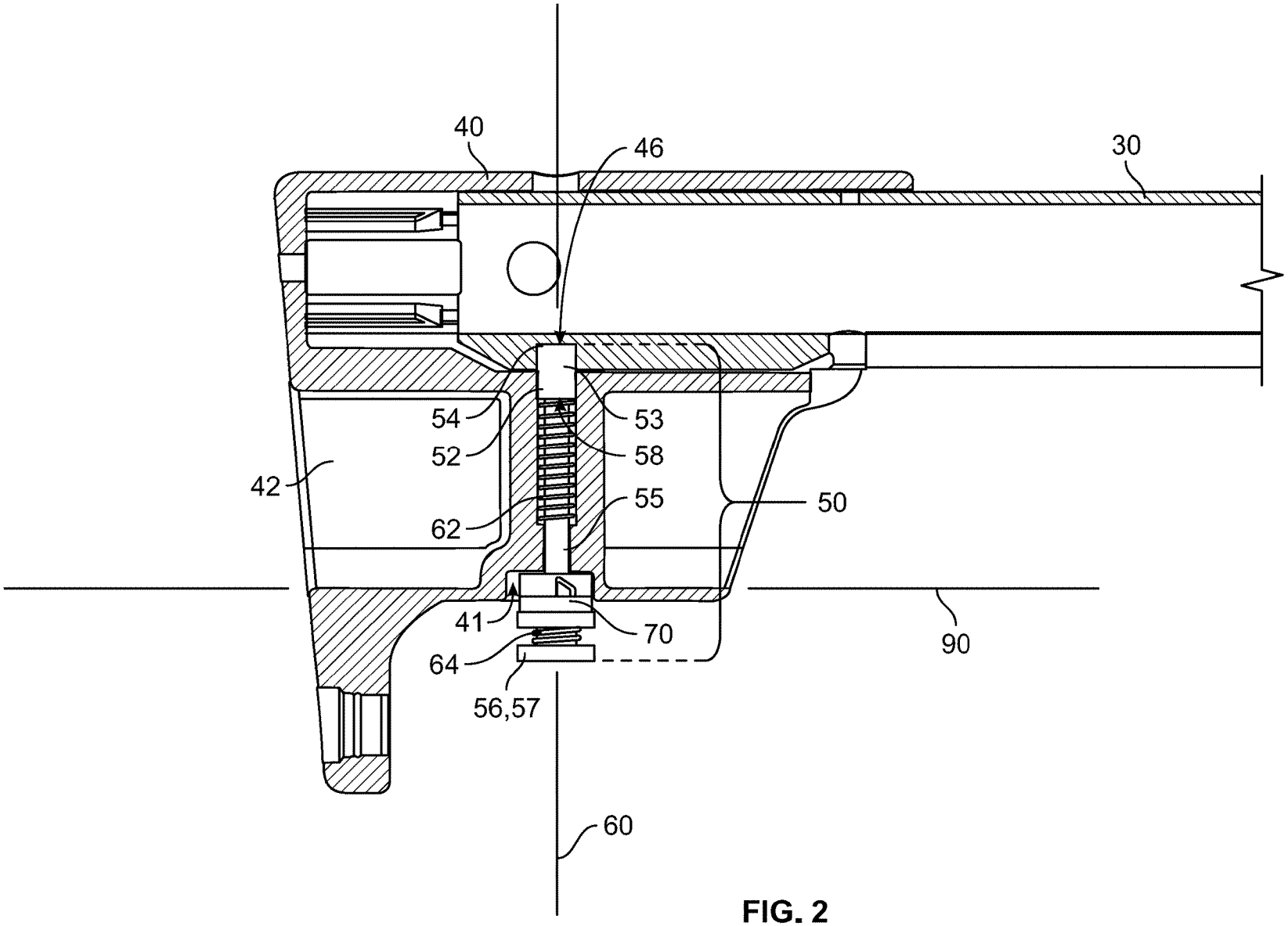
FIG. 2 is a side section view of the buttstock of the example firearm of FIG. 1 showing an example latch with a shaft engaged with a recess in the receiver.
Figure 3:
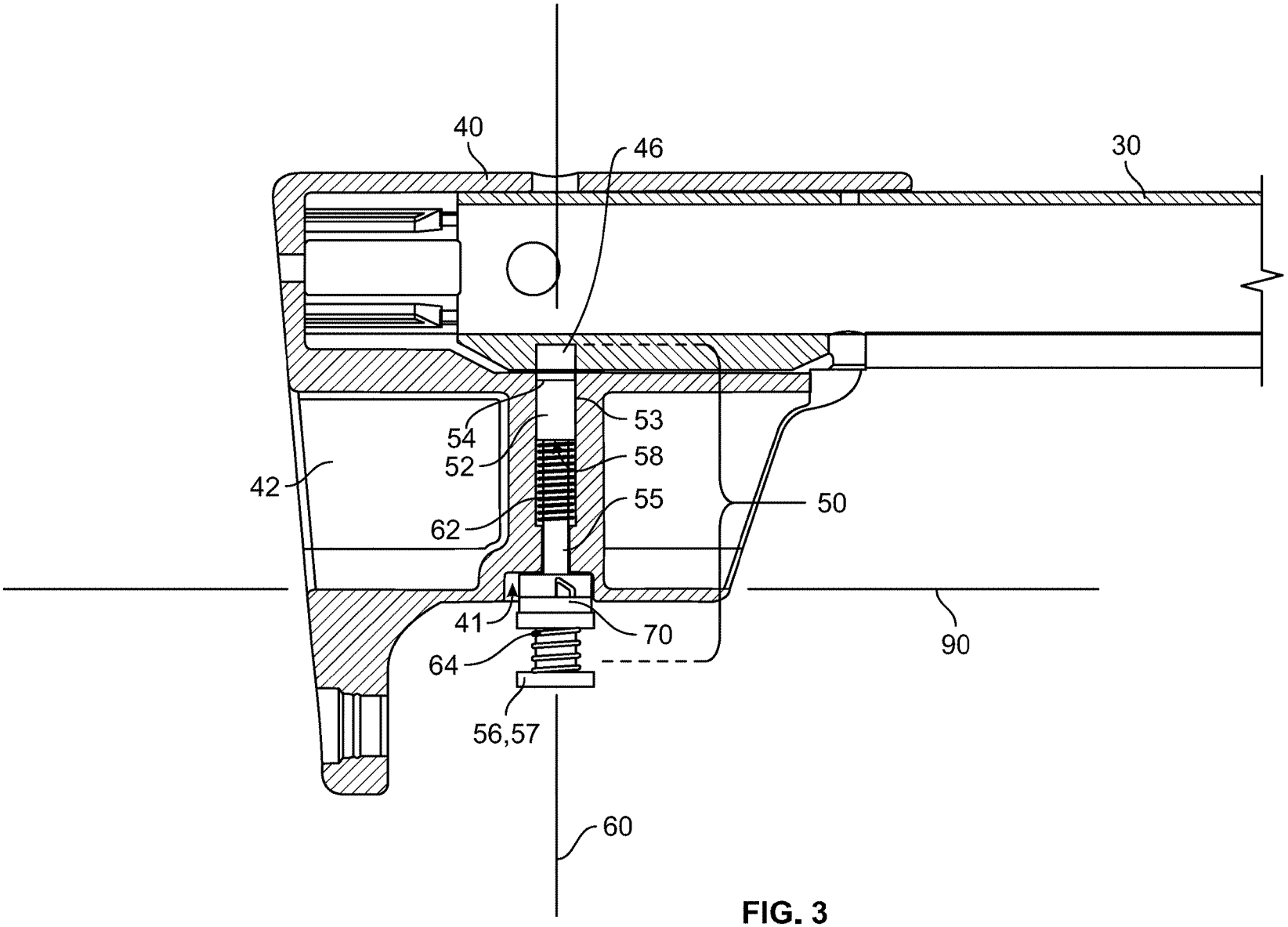
FIG. 3 is a side section view of the buttstock of the example firearm of FIG. 1 showing the example latch with the shaft disengaged from the recess in the receiver.

With reference to FIGS. 2 and 3, the latch 50 comprises a shaft 52 extending through the buttstock 40. The shaft 52 can move axially within a bore or channel of the buttstock 40 along a first axis 60. The shaft 52 includes a first end 54 and a second end 56. A first spring 62 disposed within the buttstock 40 biases the shaft 52 toward the receiver 30 to engage the first end 54 of the shaft 52 with a recess 46 of the receiver 30. It is contemplated that the first end 54 of the shaft 52 can engage the recess 46 by being received within the recess and/or by contacting a surface (e.g., an uppermost surface) of the recess. The shaft 52 may include a first portion 53 having a larger diameter than a second portion 55. As shown, the first portion 53 can be positioned above the first spring 62. The transition from the first portion 53 to the second portion 55 may create an engagement surface 58 which engages with an end of the first spring 62. The first spring 62 may act between an interior surface of the buttstock 40 and the engagement surface 58 to bias the shaft 52 toward the receiver 30 and keep the first end 54 of the shaft 52 engaged with the recess 46.

A second end 56 of the shaft 52 may include a knob 57. As shown in FIG. 3, a shooter may pull the second end 56 or knob 57 moving the shaft 52 in a direction away from the receiver (e.g., in a downward direction) along the first axis 60 and compressing the first spring 62 within the buttstock 40 to disengage the first end 54 from the recess 46 in the receiver 30. When the first end 54 is disengaged from the recess 46, the buttstock 40 is no longer coupled to the receiver 30 and can be removed from the firearm 10. In one example, the receiver 30 may have a plurality of recesses 46 along a length of the receiver 30 so that the first end 54 may engage with any recess 46 of the plurality of recesses to adjust the position of the buttstock 40 on the receiver 30 thereby adjusting the length of pull.

Figure 6:
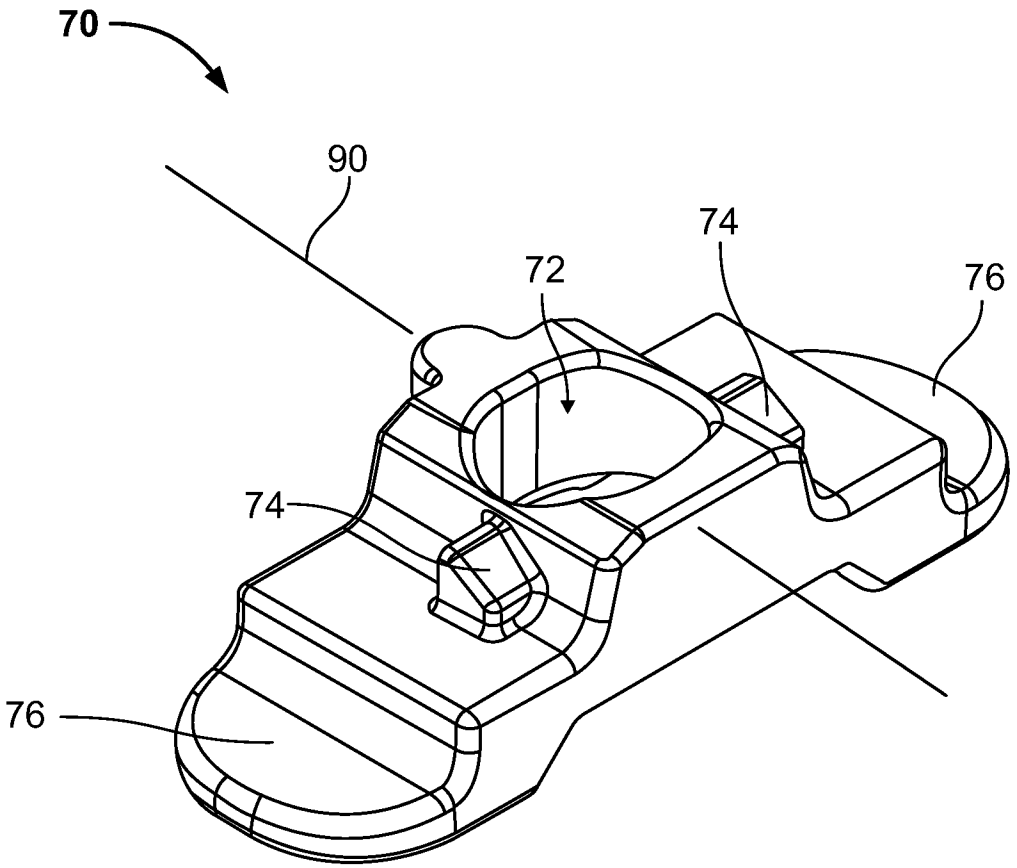
FIG. 6 is a perspective view of an example lever.

The latch 50 also includes a lever 70 positioned between a first surface 41 of the buttstock 40 and the second end 56 or knob 57 of the shaft 52. The shaft 52 extends through an opening 72 in the lever 70 as shown in FIG. 6. A second spring 64 biases the lever 70 towards the first surface 41 of the buttstock 40.

Figure 4:
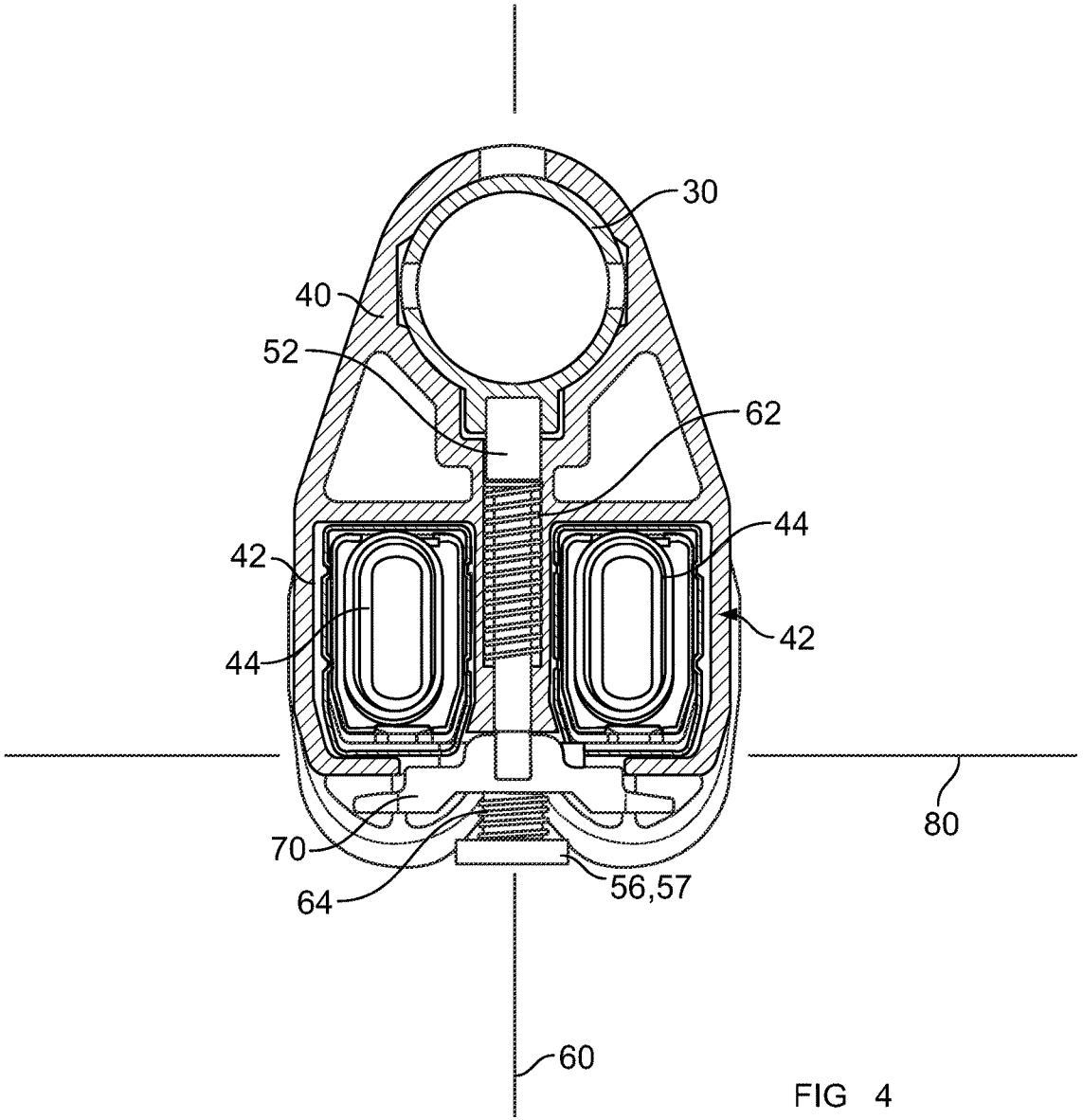
FIG. 4 is an end section view of the buttstock of the example firearm of FIG. 1 showing the example latch with a lever securing the spare magazines in the compartments of the buttstock.
Figure 5:
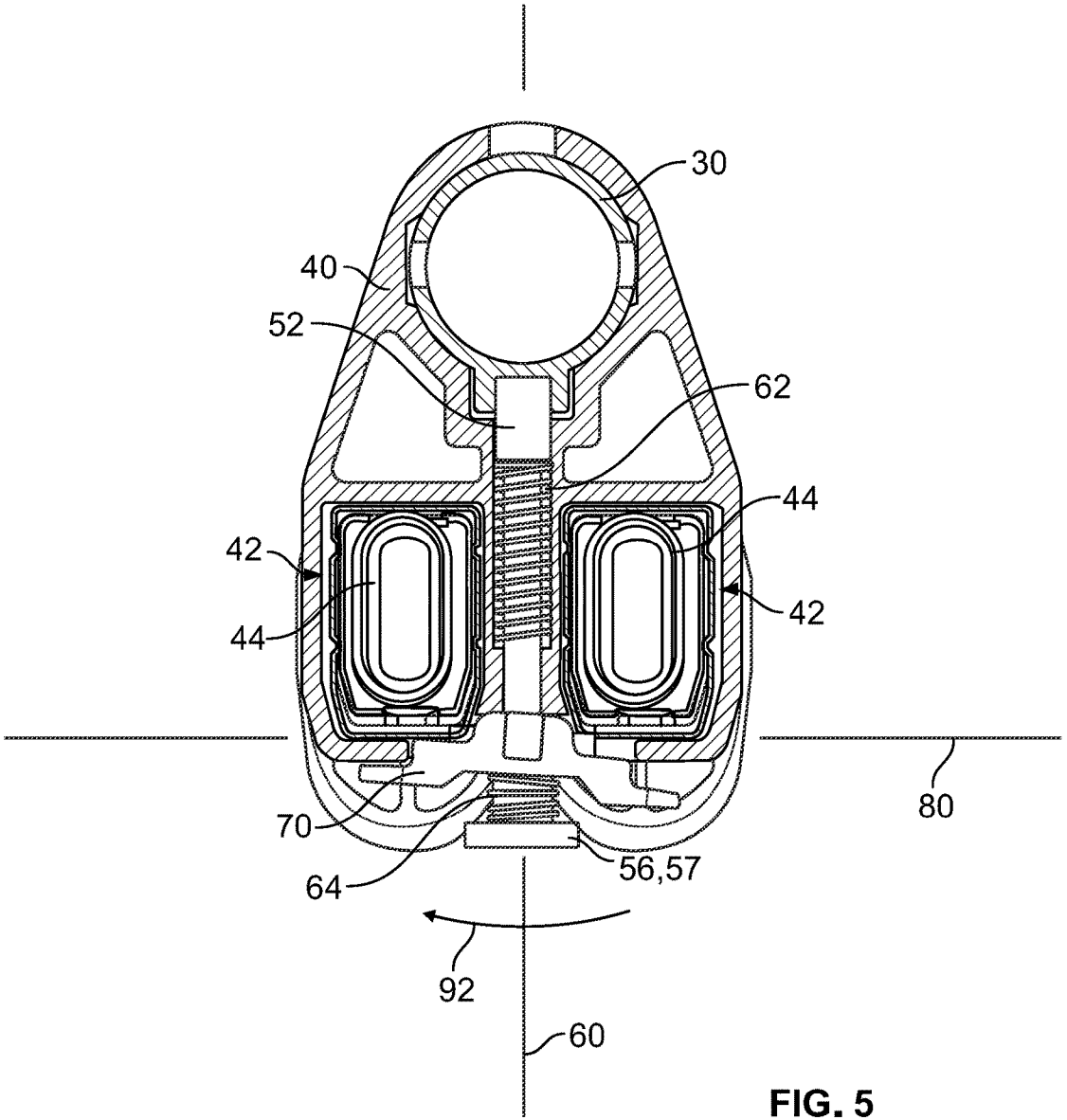
FIG. 5 is an end section view of the buttstock of the example firearm of FIG. 1 showing the example latch with the lever pivoted in a first direction.
Figure 7:
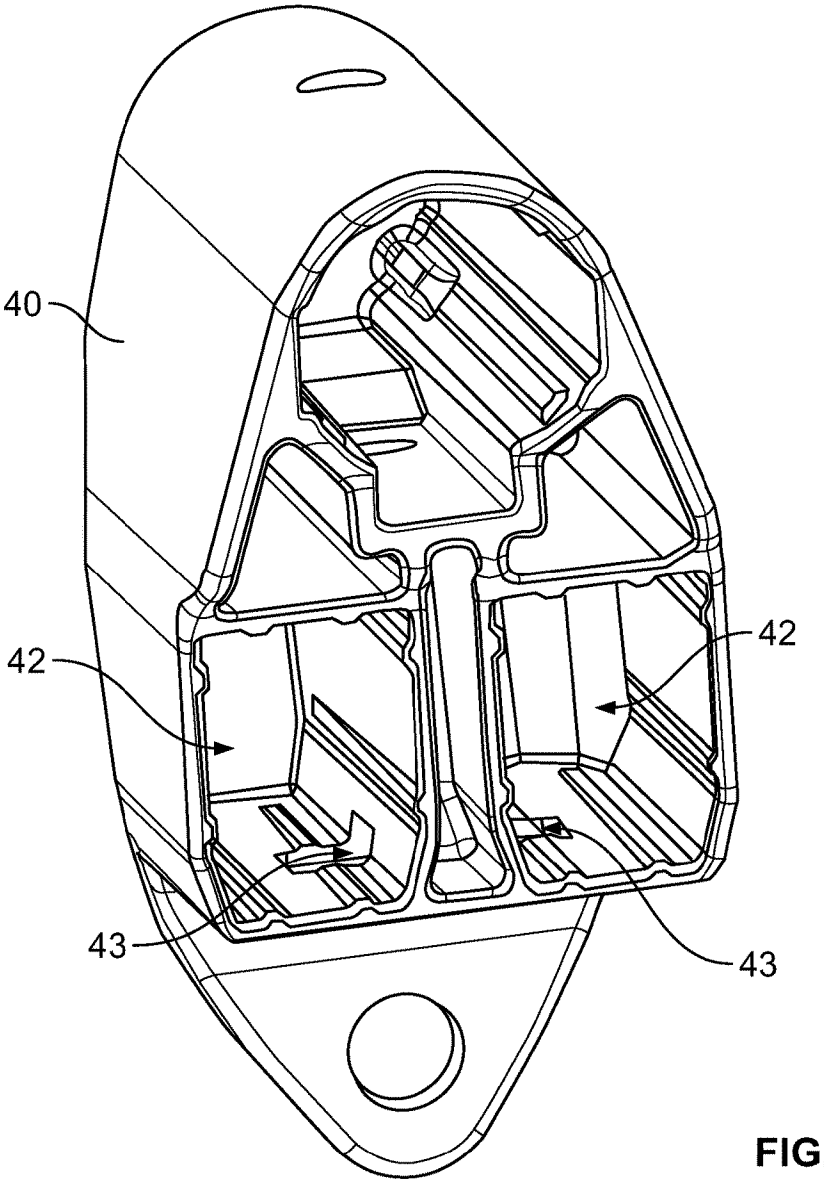
FIG. 7 is a perspective view of an example buttstock.
Figure 8:
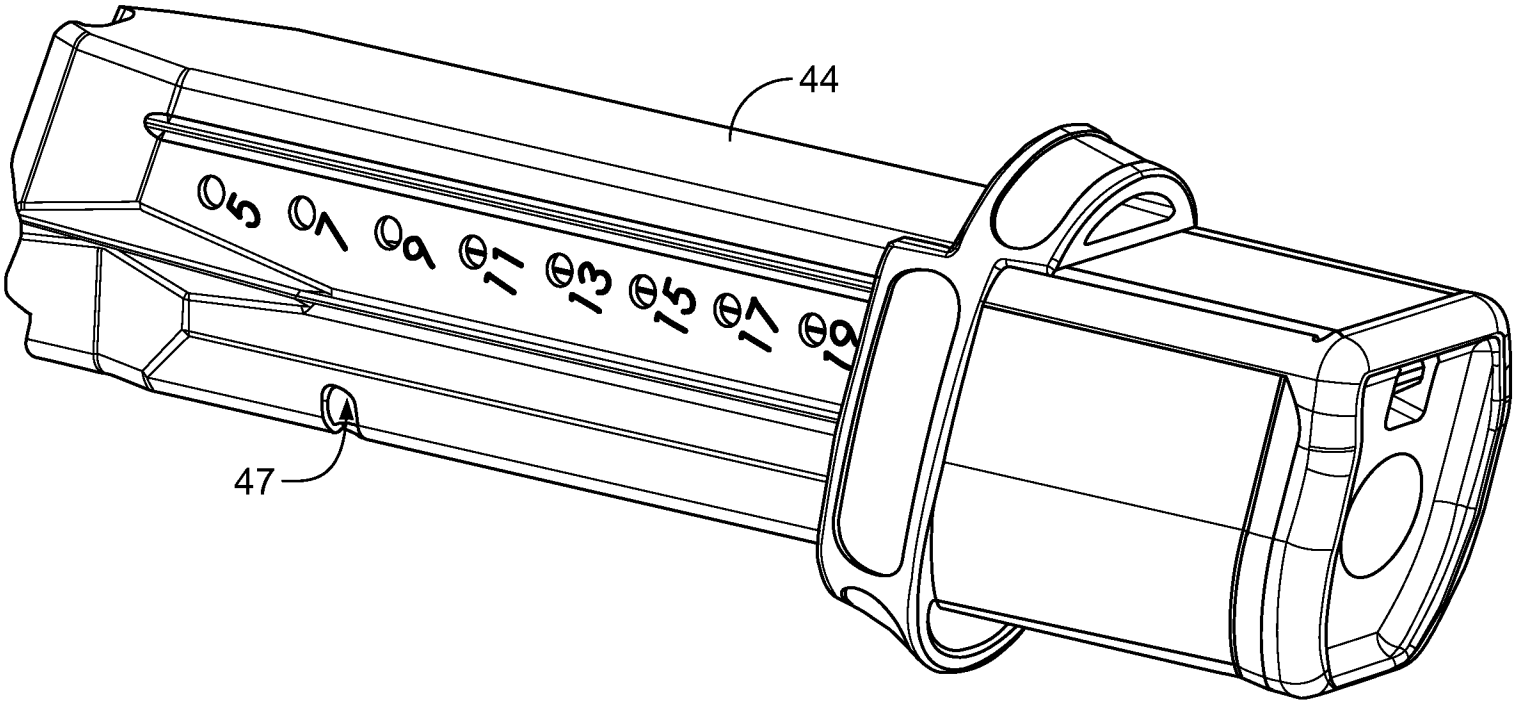
FIG. 8 is a perspective view of an example spare magazine.

As shown in FIGS. 4 and 5, the lever 70 extends along a second axis 80 transverse to the first axis 60. The lever 70 is pivotable about a third axis 90 (shown in FIGS. 2 and 3) which is transverse to the first and second axes 60, 80. The lever 70 is configured to secure the spare magazines 44 in the compartments 42. The lever 70 includes projections 74 (shown in FIG. 6) which are configured to extend through openings 43 in the compartments 42 (shown in FIG. 7) and engage with corresponding recesses 47 (e.g., locking notches) in the magazines 44 (shown in FIG. 8) to secure the spare magazine 44. The projections 74 on the lever 70 and the corresponding recesses 47 in the magazines 44 may be configured to allow the spare magazines 44 to be inserted in the compartments 42 and locked in place without the shooter actuating the lever 70. For example, the projections 74 may have a forward-facing, tapered surface to allow the magazine 44 to be pushed into the compartment 42 and secured, wherein "forward" indicates a position towards the barrel of the firearm 10. The projection 74 may further comprise a rear-facing, vertical surface that prevents the magazine 44 from being removed unless and until a shooter pivots the lever 70, wherein "rear" indicates a position towards the butt of the firearm 10. Thus, in use, the projections 74 allow the magazine 44 to be inserted simply by pressing it into place within the compartment 42, but the magazine 44 can only be removed following the pivoting of the lever 70 to effect release of the magazine 44.

As shown in FIG. 5, the lever 70 may be pivoted in a first direction 92 to disengage a projection 74 from one of the spare magazines 44 to release the magazine 44. When released, the shooter may remove the spare magazine 44 from the compartment 42. The lever 70 may be pivoted in a second direction opposite the first direction 92 to release the other spare magazine 44 from the other compartment 42. As shown in FIG. 6, the lever 70 may include tabs 76 which the shooter may press and/or pull to pivot the lever 70 in the first direction 92 or the second direction.

The second spring 64 is configured to compress on the released side while still biasing the non-released side to allow one magazine 44 to be released while the other magazine 44 remains secured within its compartment 42. Further the first spring 62 may have a spring constant greater than the spring constant of the second spring 64 so that the first spring 62 is unaffected and the buttstock 40 remains fixed to the receiver 30 when the lever 70 is pivoted.

It is expected that the example latch 50 according to the disclosure will allow a shooter to attach, remove, or adjust a buttstock 40 of a firearm 10 and secure or release spare magazines 42 from storage compartments 44 in the buttstock 40.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

What is claimed is:

1. A latch for securing a buttstock to a receiver of a firearm, said buttstock having at least one compartment configured to receive a spare magazine, said latch comprising:
   - a shaft configured to extend through said buttstock and movable along a first axis, said shaft including a first end and a second end, said first end configured to engage a recess in said receiver;
   - a lever extending along a second axis transverse to said first axis and positioned between a first surface of said buttstock and said second end of said shaft with said shaft extending through said lever, said lever including a projection configured to extend through an opening in said first surface of said buttstock and engage with said spare magazine to secure said spare magazine within said at least one compartment, wherein said lever is pivotable about a third axis that is perpendicular to said first and second axes, and wherein said projection is configured to release said magazine when said lever is pivoted in a first direction;
   - a first spring disposed within said buttstock with said shaft extending therethrough, said first spring biasing said shaft toward said receiver; and
   - a second spring acting between said second end of said shaft and said lever with said shaft extending therethrough, said second spring biasing said lever toward said first surface of said buttstock.

2. The latch of claim 1, wherein said lever includes a second projection configured to extend through a second opening in said first surface of said buttstock and engage with a second magazine received within a second compartment of said buttstock.

3. The latch of claim 2, wherein said second projection is configured to release said second magazine when said lever is pivoted in a second direction that is opposite said first direction.

4. The latch of claim 1, wherein a first spring constant of said first spring is greater than a second spring constant of said second spring.

5. The latch of claim 1, wherein said second end of said shaft includes a knob having a diameter that is larger than a diameter of said second spring.

6. The latch of claim 1, wherein a first portion of said shaft has a larger diameter than a second portion of said shaft.

7. The latch of claim 6, wherein said first portion comprises said first end of said shaft.

8. The latch of claim 6, wherein a transition between said first portion and said second portion forms an engagement surface.

9. The latch of claim 8, wherein said first spring acts between an interior surface of said buttstock and said engagement surface.

10. A removable or adjustable buttstock for a firearm, said buttstock comprising:

at least one compartment configured to store a magazine; and a latch configured to secure said buttstock to a receiver of said firearm and configured to secure the magazine in said at least one compartment.

11. The buttstock of claim 10, wherein said latch comprises:

a shaft extending through said buttstock and movable along a first axis, said shaft including a first end and a second end, said first end configured to engage a recess in said receiver;

a lever extending along a second axis transverse to said first axis and positioned between a first surface of said buttstock and said second end of said shaft with said shaft extending through said lever, said lever including a projection configured to extend through an opening in said first surface of said buttstock and engage with said magazine to secure said magazine within said at least one compartment, wherein said lever is pivotable about a third axis that is perpendicular to said first and second axes, wherein said projection is configured to release said magazine when said lever is pivoted in a first direction;

a first spring disposed within said buttstock with said shaft extending therethrough, said first spring biasing said shaft toward said receiver; and a second spring acting between said second end of said shaft and said lever with said shaft extending therethrough, said second spring biasing said lever toward said first surface of said buttstock.

12. The buttstock of claim 11, wherein said lever includes a second projection configured to extend through a second opening in said first surface of said buttstock and engage with a second magazine received within a second compartment of said buttstock.

13. The buttstock of claim 12, wherein said second projection is configured to release said second magazine when said lever is pivoted in a second direction that is opposite said first direction.

14. The buttstock of claim 11, wherein a first spring constant of said first spring is greater than a second spring constant of said second spring.

15. A firearm comprising:

a barrel;

a receiver connected to said barrel; and a buttstock connected to said receiver, said buttstock comprising:

at least one compartment configured to store a magazine; and a latch configured to secure said buttstock to a receiver of said firearm and configured to secure the magazine in said at least one compartment.

16. The firearm of claim 15, wherein said latch comprises:

a shaft extending through said buttstock and movable along a first axis, said shaft including a first end and a second end, said first end configured to engage a recess in said receiver;

a lever extending along a second axis transverse to said first axis and positioned between a first surface of said buttstock and said second end of said shaft with said shaft extending through said lever, said lever including a projection configured to extend through an opening in said first surface of said buttstock and engage with said magazine to secure said magazine within said at least one compartment, wherein said lever is pivotable about a third axis that is perpendicular to said first and second axes, and wherein said projection is configured to release said magazine when said lever is pivoted in a first direction;

a first spring disposed within said buttstock with said shaft extending therethrough, said first spring biasing said shaft toward said receiver; and a second spring acting between said second end of said shaft and said lever with said shaft extending therethrough, said second spring biasing said lever toward said first surface of said buttstock.

17. The firearm of claim 16, wherein said lever includes a second projection configured to extend through a second opening in said first surface of said buttstock and engage with a second magazine within a second compartment of said buttstock.

18. The firearm of claim 17, wherein said second projection is configured to release said second magazine when said lever is pivoted in a second direction that is opposite said first direction.

19. The firearm of claim 16, wherein a first spring constant of said first spring is greater than a second spring constant of said second spring.

20. The firearm of claim 16, wherein said recess in said receiver is one of a plurality of recesses along said receiver.

* * * * *